United States Patent [19]

Giebel

[11] Patent Number: 4,601,257

[45] Date of Patent: Jul. 22, 1986

[54] ADHESIVE APPLICATOR DEVICE IN A CEMENT LASTING MACHINE

[75] Inventor: Gerhard Giebel, Bad Soden, Fed. Rep. of Germany

[73] Assignee: USM Corporation, Farmington, Conn.

[21] Appl. No.: 746,449

[22] Filed: Jun. 19, 1985

Related U.S. Application Data

[63] Continuation of Ser. No. 597,476, Apr. 6, 1984, abandoned.

[30] Foreign Application Priority Data

Mar. 31, 1983 [DE] Fed. Rep. of Germany ..... 3311940

[51] Int. Cl.[4] ..... B05C 5/02; B05C 5/04

[52] U.S. Cl. ..... 118/411; 12/10.5

[58] Field of Search ..... 118/410, 411, 412, 407; 12/10.5

[56] References Cited

U.S. PATENT DOCUMENTS

| | | | |
|---|---|---|---|
| 3,575,137 | 4/1971 | Marquis | 118/411 X |
| 3,918,394 | 11/1975 | Vornberger | 118/411 X |
| 4,204,496 | 5/1980 | Ikegami et al. | 118/405 |
| 4,517,697 | 5/1985 | Vornberger | 118/411 X |

FOREIGN PATENT DOCUMENTS

| | | | |
|---|---|---|---|
| 2013065 | 9/1971 | Fed. Rep. of Germany | 118/411 |

*Primary Examiner*—John P. McIntosh

*Attorney, Agent, or Firm*—Spencer T. Smith

[57] ABSTRACT

Adhesive applicator device in a cement lasting machine comprising an adhesive applicator element provided for the shoe toe and two adhesive rails adjacent the adhesive applicator element. The adhesive applicator rails are secured to the adhesive applicator element by means of a ball joint and on the opposite side are connected by a further ball joint with a push-rod. By virtue of the two-sided ball joint journalling the two adhesive applicator rails can thus accommodate to any position of the lasting margin.

3 Claims, 4 Drawing Figures

ADHESIVE APPLICATOR DEVICE IN A CEMENT LASTING MACHINE

This application is a continuation of Ser. No. 597,476, filed Apr. 6, 1984, now abandoned.

BACKGROUND OF THE INVENTION (1.) Field of the Invention

This invention is concerned with an adhesive applicator device in a cement lasting machine in which the lasting margin of a shoe on a last is secured on the margin of an insole by means of adhesive applied to the forepart of the shoe bottom, comprising an adhesive applicator element provided for the shoe toe and two adhesive applicator rails adjoining the adhesive applicator element, which rails can both swing parallel to the insole and also pivot perpendicularly to the insole about pivot points which lie at the ends of the rails adjacent the adhesive applicator element.

(2.) Description of the Prior Art

One such adhesive applicator device is known from DE-OS No. 2013065. In this case the two adhesive applicator rails are journalled closely adjacent the adhesive applicator element on two axes which are perpendicular to one another and which enable the adhesive applicator rails on the one hand to swing parallel to the insole and on the other to pivot perpendicularly to the insole. By virtue of the swinging capability the adhesive applicator rails are accommodated to the different directions of the lasting margin in left and right shoes, by virtue of the pivoting capability the adhesive applicator rails can accommodate two different springs (of the shoe bottom).

BRIEF SUMMARY OF THE INVENTION

This invention is based on the object of simplifying the journalling of the adhesive applicator rails and at the same time of giving them an extensive facility for accommodating to the contour of the insole in the region of the lasting margin.

In accordance with the invention this occurs in that the forward end of each of the adhesive applicator rails is mounted on a first ball joint and the rearward end of each of the adhesive applicator rails runs into a second ball joint which engages in a push-rod which is arranged for in and out movement in the direction of the insole and also for movement somewhat parallel to the insole and transversely of the adhesive applicator rails, the two ball joints forming for each adhesive applicator rail a tilt linkage for the purpose of accommodating to a transverse contour of the insole.

By virtue of the journalling of the adhesive applicator rails on ball joints which are arranged in the region of both their ends a tilt capability of the adhesive applicator rails is achieved beyond the Cardan joint known from DE-OS No. 2013065, this capability making it possible for the adhesive applicator rails to accommodate to transverse contours of the insole, in addition to the swinging capability for the purpose of accommodating to right and left shoes and the pivoting capability for the purpose of compensating for different springs. The two ball linkages thus form for the adhesive applicator rails such a constructionally simple journal which gives the adhesive applicator rails each capability of movement conceivable in this context and thus the possibility of accommodating to each position of the insole. By means of the push-rod the adhesive rail can both swing and also pivot about the second ball joint, a tilting movement of the adhesive applying rails then arising automatically as a consequence of the adhesive rails pressing against the insole, and the rails thus being oriented by the tilting movement against the insole.

Suitably the adhesive can be supplied via the first ball joint of the adhesive applicator rails in question, more particularly in that the first ball joint has a bore therethrough and is connected at the one side with an adhesive supply and at the other with adhesive channels running inside the adhesive applicator rails. Conveniently the first ball joint is thus so formed that it is constituted by a bolt with a ball head, which bolt projects into the adhesive applicator rail, and a ball-socket arranged in the adhesive applicator rail.

The push-rod may conveniently be in the form of a component of a piston-and-cylinder unit, which is journalled on a third ball joint at its side facing away from the second ball joint, the piston-and-cylinder unit being connected with a pusher which is movable transversely of the longitudinal direction of said unit. The third ball joint thus gives each capability of movement to the appropriate mounting point of the piston-and-cylinder unit in a constructionally simple way.

For effecting the transverse movement of the piston-and-cylinder unit the pusher may be in the form of a plate having two holes for receiving the two piston-and-cylinder units, which plate is connected with a pusher mechanism.

BRIEF DESCRIPTION OF THE DRAWINGS

In the drawings one exemplary embodiment of the invention is shown, wherein.

DESCRIPTION OF THE PREFERRED EMBODIMENT

Figure 1:
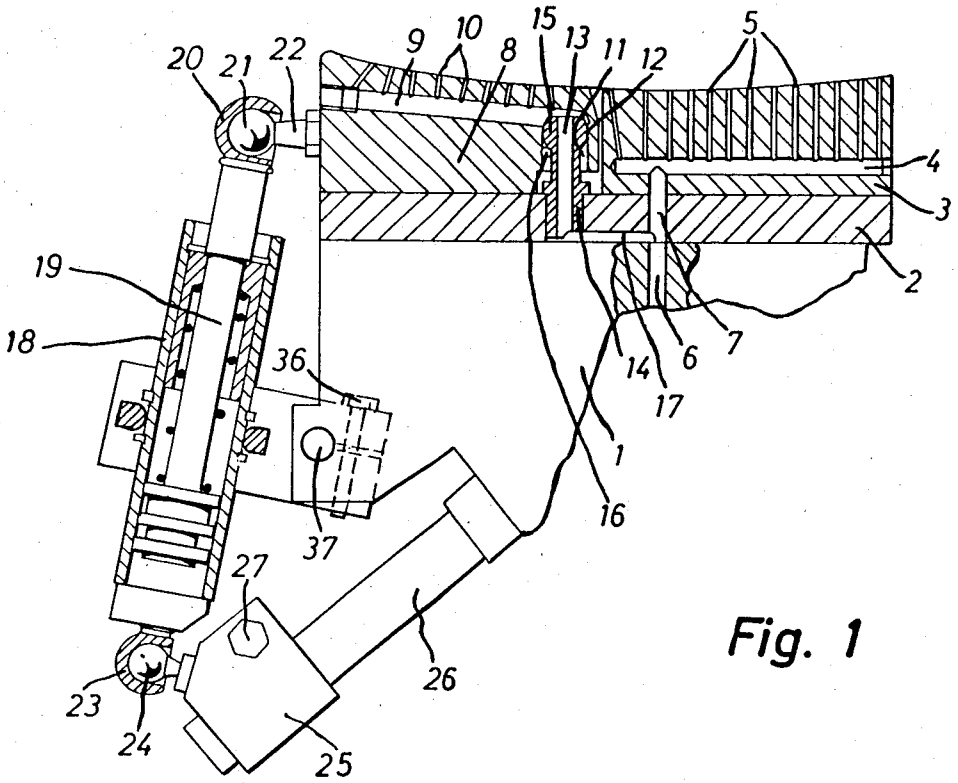
FIG. 1 shows the adhesive applicator device in side view, partly in section, in the initial position.

In accordance with FIG. 1 the carrier plate 2 is fixedly mounted on the injection head 1, and the adhesive applicator element 3 is fixed on said plate. In this connection it is a matter of a known component which is provided with an adhesive distributor channel 4 and several adhesive exit channels 5, through which in a known manner adhesive is applied to the margin of an insole of a shoe to be lasted. The adhesive passes into the adhesive distributor channel 4 through the adhesive bore 6 in the injection head 1, from which, via the aperture 7 in the carrier plate 2 and in the adhesive applicator element 3, a connection to the adhesive distributor channel 4 arises. The adhesive bore 6 is connected to an adhesive supply in a known manner which is not of interest here.

Figure 4:
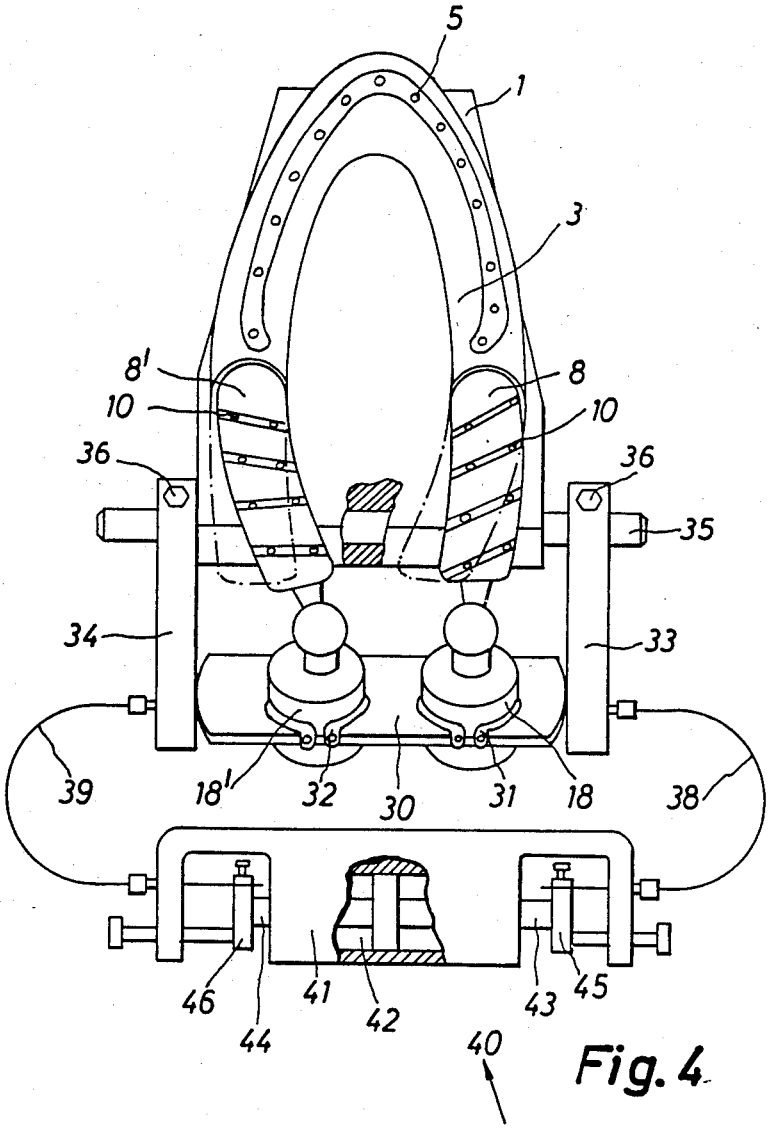
FIG. 4 shows a plan view of the device according to FIGS. 1 and 2.

On the carrier plate 2, furthermore, is journalled the adhesive applicator rail 8 (the second adhesive applicator rail is not visible here, however it can be seen in FIG. 4). This also has an adhesive distributor channel 9 from which several exit channels 10 branch. At its forward end facing the adhesive applicator element 3, the adhesive applicator rail 8 is provided with the bore 11 which ends in the ball socket 12. The bore 11 thus has a diameter corresponding to the ball socket 12. In the bore 11 is inserted the bolt 14 which is provided with the bore 13 and which ends in the ball 15. The ball 15 sits in the ball socket 12 and is secured in this position by a spring clip 16. There is thus provided for the adhesive applicator rail 8, at its side facing the adhesive applicator element 3, that is to say at its forward end, a first ball joint which, in the case of raising the adhesive applicator rail 8 from the carrier plate 2, gives to the rail 8 the possibility of tilting as well as the possibility of swinging and pivoting. The bore 13 in the bolt 14 is connected on the one hand with the adhesive branch channel 17 and on the other hand with the adhesive distributor channel 9, the adhesive branch channel 17 opening into the aperture 7, so that adhesive on the way via the adhesive bore 6, the aperture 7 and the adhesive branch channel 17 passes into the bore 13 from which then the adhesive flows into the adhesive distributor channel 9 and the exit channels 10. The bolt 14 is pressed into the carrier plate 2, whereby a secure journal is provided for the first ball joint formed from the ball 15 and ball socket 12.

In order to swing and pivot the adhesive applicator rail 8, the piston-and-cylinder arrangement 18 is provided with the piston rod 19 which here also forms the push-rod for the adhesive applicator rail 8. The piston rod 19 ends in the ball socket 20 in which the ball 21 of the bolt 22 is journalled. Ball socket 20 and ball 21 form the second ball joint. The bolt 22 is pressed into the adhesive applicator rail 8. On its end away from the bolt 22 the piston-and-cylinder unit 18 is journalled on a third ball joint, formed by the ball socket 23 and the ball 24. The latter is secured to the holder 25. The holder 25 is clamped on the rod 26 in known manner by means of the hexogonal screw 27. The rod 26 is secured on the injection head 1.

Figures 2, 3:
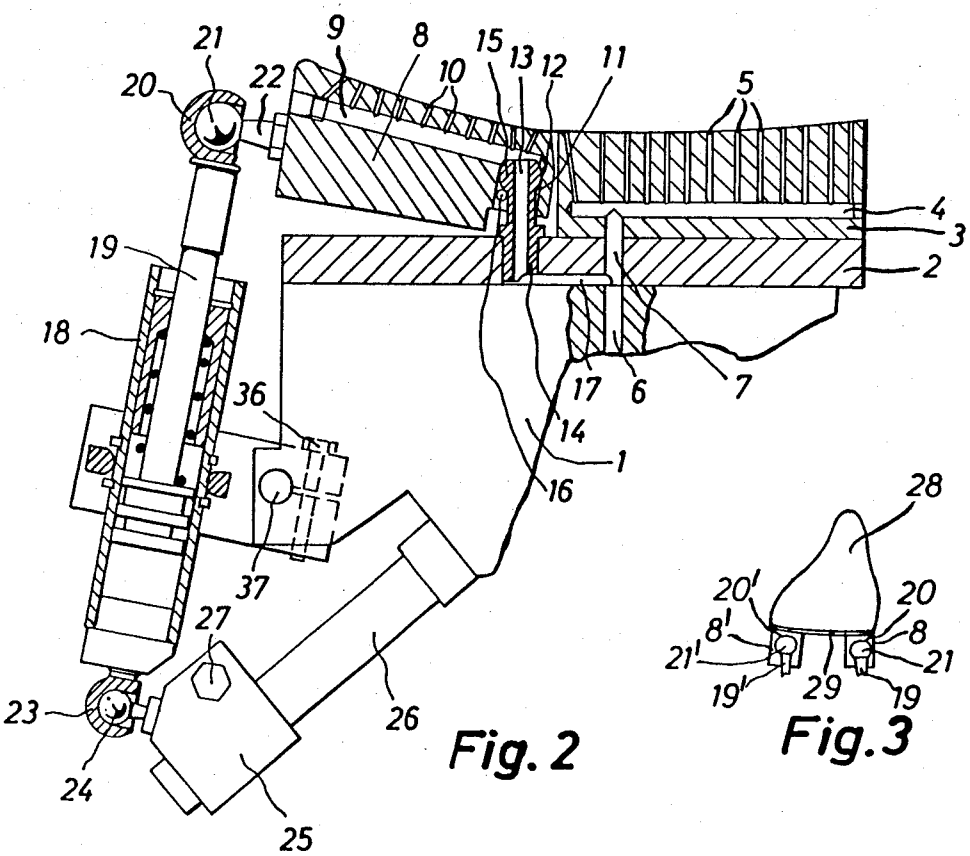
FIG. 2 shows the same device with adhesive applicator rails pivoted.
FIG. 3 shows in schematic representation slightly tilted adhesive applicator rails.

If now the piston-and-cylinder unit 18 is actuated by control means which are of no interest in this connection, its piston rod 19 is extended, whereupon the piston rod 19 assumes the position shown in FIG. 2. If now the injection head 1 in this position of the adhesive applicator element 3 and the adhesive applicator rail 8 is advanced against a shoe to be lasted, then the adhesive applicator rail 8 runs down on the appropriate part of the insole and thus takes the position determined by the insole, the piston rod 19 yielding correspondingly. This is made possible for example by a pneumatic actuation. The requisite relative movement between piston rod 19 and adhesive applicator rail 8 is made possible by the second ball joint, formed by the ball socket 20 and the ball 21.

If now, while the insole and adhesive applicator rail 8 are in pressing engagement, a transverse contour of the insole is to be compensated for, then this arises by a corresponding tilting movement of the adhesive applicator rail 8, as this is shown in schematic manner in FIG. 3. The last 28 with the insole 29 secured thereto is shown here (the upper drawn over the last 28 is omitted for reasons of clarity). Pressing against the insole 29 are the two adhesive applicator rails 8 and 8' which assume a tilting position accommodated to the transverse contour of the insole 29 by virtue of their journalling on the first and second ball joints. In FIG. 3 therefore are illustrated, still schematically, the second ball joints formed from ball 21/21' and ball socket 20/20'.

In FIG. 4 is illustrated in plan view the device according to FIGS. 1 and 2. As can be seen, the two adhesive applicator rails 8 and 8' are adjacent the adhesive applicator element 3. For reasons of clarity of the illustration, in FIG. 4 the drawing in of the first ball joint has been omitted. From FIG. 4 is seen in detail the pusher mechanism for the adhesive applicator rails 8 and 8'. The two piston-and-cylinder units 18 and 18' are guided by two corresponding apertures in the plate 30 and secured in this plate by securing rings 31 and 32. A lateral movement of the plate 30 thus leads to a corresponding movement of the two piston-and-cylinder units 18 and 18'. The plate 30 is held between the two stops 33 and 34, which are clamped by means of the hexagonal screws 36 on the axis 35 of movement. In the event of axial movement of the axis 35 of movement the stops 33 and 34 move therewith, which in turn then move the plate 30 correspondingly. The axis 35 of movement is journalled slidingly at its center in a bore 37 of the injection head 1 (see also FIGS. 1 and 2). Upon movement of the axis 35 of movement and thus correspondingly of the plate 30 the piston-and-cylinder units 18 and 18' move therewith, which correspondingly move the second ball joints consisting of ball 21 and ball socket 20, whereby the adhesive applicator rails 8 and 8' are swung together, so that they are swung from the position shown in full lines in FIG. 4 into the position shown in chain-dot lines and back. In this way the accommodation to a right or left shoe is achieved.

The third ball joint, consisting of ball 24 and ball socket 23, permits the piston-and-cylinder units 18 or 18' also this swinging movement. Since in this swinging movement it is a question only of a relatively short movement of the plate 30, it is sufficient if, for achieving the swinging movement of the piston-and-cylinder units 18 and 18', the bores which receive the two piston-and-cylinder units are bored conically in the plate 30 from both sides, so that in the region of the narrowest part of the two bores the two piston-and-cylinder units are embraced practically play-free.

In order to make possible the to-and-fro movement of the two stops 33 and 34, they are connected via the Bowden cables 38 and 39 to the pusher mechanism 40 which consists of the housing 41 with piston-and-cylinder unit 42 arranged thereon. The piston-and-cylinder unit 42 has at both its sides a piston rod 43 and 44 which each move therewith an element 45 and 46 respectively, a Bowden cable 38 and 39 respectively being clamped to each element. By virtue of a movement of the two piston rods 43 and 44 a drafting force is thereby applied to the plate 30 via the corresponding Bowden cable 38 and 39, and thus a corresponding movement of the plate 30 is achieved.

I claim:

1. A machine for lasting shoes wherein the lasting margin of a lasted shoe upper is secured to the margin of the insole by means of adhesive supplied to the forepart of the shoe bottom, comprising an adhesive applicator element including aperture means for delivering adhesive to the forepart of the shoe bottom, first and second adhesive applicator rail means adjacent to and extending heelwardly from either side of said adhesive applicator element, carrier plate means having first and second ball joint means for supporting the toe end of said first and second adhesive applicator rail means whereby said first and second adhesive application rail means can each be pivotally displaced about a first axis parallel to the insole and about a second axis perpendicular to the insole, first and second cylinder means, ball joint means for connecting one end of each of said cylinder means to the heel end of a respective one of said first and second adhesive applicator rail means whereby each of said first and second adhesive applicator rail means, when brought into engagement with an insole, can automatically reorient about a third axis extending between the ball joint means at either end thereof to establish mating contact with the insole, ball joint means for connecting the other end of each of said cylinder means to said carrier plate means, cylinder mounting means including cylinder plate means, mean for mounting said cylinder mounting means on said carrier plate means for displacement in a selected direction, means for displacing said cylinder mounting means in said selected direction, means for mounting each of said cylinder means on said cylinder plate means for limited pivotal movement relative thereto, whereby each of said cylinder means may reorient relative to said cylinder plate means during the displacement of said cylinder mounting means.

2. A machine for lasting shoes according to claim 1, wherein said means for displacing said cylinder mounting means comprises cable means.

3. A machine for lasting shoes according to claim 2, wherein said first and second ball joint means include aperture means for delivering adhesive to said applicator rail means.

* * * * *